US005135445A

United States Patent [19]

Christensen et al.

[11] Patent Number: 5,135,445

[45] Date of Patent: Aug. 4, 1992

[54] NECK EXERCISING APPARATUS

[76] Inventors: Kim D. Christensen, 18604 NW. 64th Ave., Ridgefield, Wash. 98642; Kent S. Greenawalt, 5056 Hunting Hills Sq., Roanoke, Va. 24014; C. F. Sunny Sporer, R.D. 1, Box 36P, Henry, Va. 24102; J. Forrest Moore, 4825 Brookwood Dr., Roanoke, Va. 24018

[21] Appl. No.: 692,853

[22] Filed: Apr. 29, 1991

[51] Int. Cl.[5] ..... A63B 23/025

[52] U.S. Cl. ..... 482/10; 482/904; 482/122; 482/129; 482/89

[58] Field of Search ..... 272/94, 136, 135, 143, 272/900, 76, 77, 78, 140; 128/25 R

[56] References Cited

U.S. PATENT DOCUMENTS 2,049,434 8/1936 Erickson .
2,633,124 3/1953 Yeuin .
2,701,564 2/1955 Wilhelm .
4,239,209 12/1980 Curchod ..... 272/76
4,278,249 7/1981 Forrest .
4,537,393 8/1985 Kusch .
4,662,629 5/1987 Plovie ..... 272/900
4,662,630 5/1987 Dignard et al. ..... 272/76

FOREIGN PATENT DOCUMENTS 677775 8/1952 United Kingdom ..... 272/DIG. 4

*Primary Examiner*—Richard J. Apley
*Assistant Examiner*—Lynne Reichard
*Attorney, Agent, or Firm*—Henderson & Strum

[57] ABSTRACT

A neck exercising apparatus (10) including an elongated support member (14) adapted to be suspended from a door (100) and operatively connected to a generally U-shaped leaf spring member (20) having a head rest member (30) movably attached to the outboard leg (22) of the spring member (20); wherein, the position of the head rest member (30) on the spring member (20) determines the amount of resistance provided by the spring member (20).

5 Claims, 1 Drawing Sheet

NECK EXERCISING APPARATUS

TECHNICAL FIELD

The present invention relates to the field of exercise devices in general, and in particular to an apparatus specifically designed to allow the user to perform exercises to strengthen their necks.

BACKGROUND ART

As can be seen by reference to the following U.S. Pat. Nos. 4,278,249; 4,537,393; 2,701,564; and 2,633,124; the prior art is replete with myriad and diverse neck exercising and/or traction devices that are used in conjunction with physical therapy involving the users neck.

While all of the aforementioned prior art constructions are more than adequate for the basic purpose and function for which they have been specifically designed, these patented devices are uniformly deficient with regard to the fact that they are both unduly structurally complex as well as inadequate with respect to the number and variety of range of motion exercises that can be performed through use of the devices in their intended manner.

As most health professionals are aware most common neck injuries require that the patient be put through exercises that require varying degrees of flexion, extension and rotation to both strengthen the neck muscles and return the normal range of motion to the users neck and head.

As a consequence of the foregoing situation, there has existed a longstanding need for a relatively simple and inexpensive resistance producing neck exercising apparatus that can be employed to exercise a users neck in varying ranges in the modes of flexion, extension and rotation; and, the provision of such a construction is a stated objective of the present invention.

DISCLOSURE OF THE INVENTION

Briefly stated, the neck exercising apparatus that forms the basis of the present invention involves: a primary support unit; a resilient resistance unit; and a head rest unit.

The primary support unit comprises in general an elongated support member having a suspension hook element formed on one end which is adapted to fit over the top of a standard door to suspend the apparatus from the door.

The resistance unit comprises in general a contoured resilient leaf spring member which is adapted to be movably secured on one end to the support unit and operatively connected to the head rest unit.

As will be explained in greater detail further on in the specification, the head rest unit comprises a head rest member which is movably disposed on the contoured leaf spring member such that the chosen location of the head rest member relative to the leaf spring member will determine the amount of resistance provided by the leaf spring member.

In addition the orientation of the users head and neck relative to the head rest member such as face forward, face rearward, left face and right face will permit the user to perform a wide range of motions involving flexion, extension, and rotation of the affected muscle groups.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
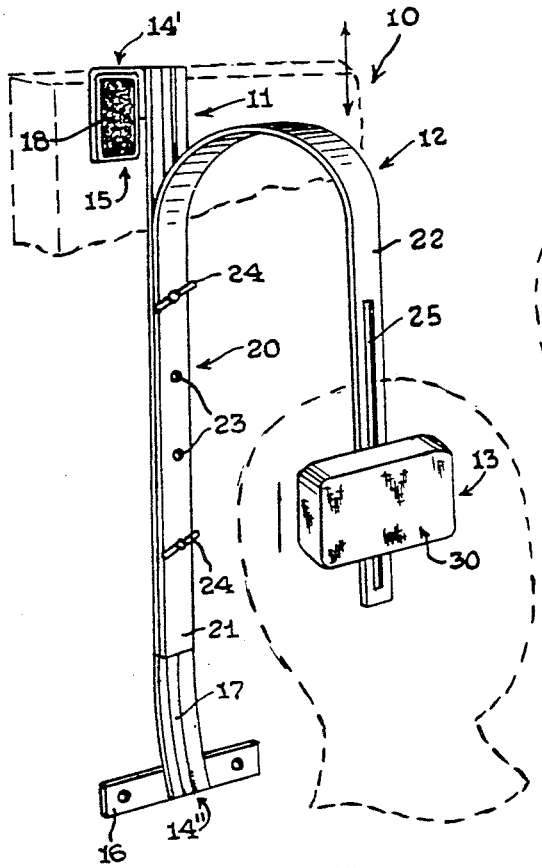
FIG. 1 is a perspective view of the apparatus.

As can be seen by reference to the drawings, and in particular to FIG. 1, the neck exercising apparatus that forms the basis of the present invention is designated generally by the reference numeral (10). The apparatus (10) comprises in general a support unit (11); a resistance unit (12) and a head rest unit (13). These units will now be described in seriatim fashion.

Figure 2:
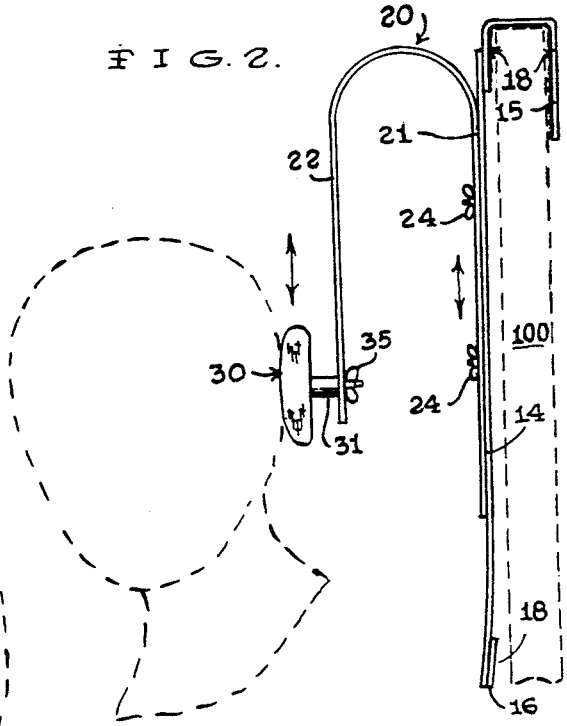
FIG. 2 is a side plan view of the apparatus.
Figure 3:
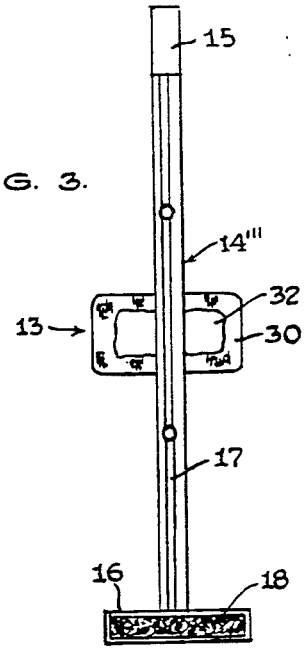
FIG. 3 is a rear plan view of the apparatus.

As shown in FIGS. 1, 2, and 3, the support unit (11) comprises a generally straight elongated relatively rigid support member (14) having a hook element (15) provided on its upper end (14'); wherein, the hook portion (15) is dimensioned to fit over the top of a standard door designated generally as (100).

In addition, the lower end (14'') of the support member (14) is curved slightly outwardly and provided with a generally flat horizontal brace element (16); wherein the brace element (16) and the lower end (14'') of the support member are slightly spaced from the face of the door (100), when the intermediate portion (14''') of the support member (14) is in contact with the door.

Furthermore, the intermediate portion (14''') of the support member (14) is provided with an elongated slot (17); and, both the hook element (15) and the brace element (16) are provided with cushioning members (18) to prevent the apparatus (10) from marring the finish on the door (100).

Figure 4:
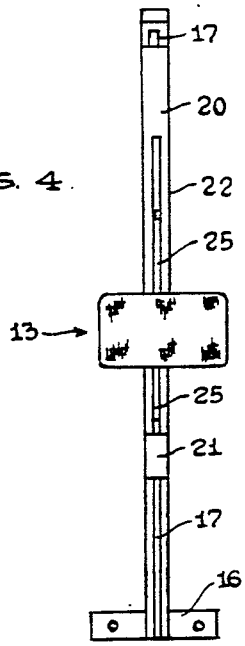
FIG. 4 is a front plan view of the apparatus.

As can best be seen by reference to FIGS. 1, 2, and 4, the resistance unit (12) comprises in general a contoured generally U-shaped leaf spring member (20) having a generally elongated inboard leg (21) and a somewhat shorter outboard leg (22); wherein, the inboard leg (21) is provided with a plurality of discrete mounting apertures (23) dimensioned to receive standard fastening members (24) for operatively connecting the inboard leg (21) of the spring member (20) at a selected height relative to the intermediate portion (14''') of the support member (14); and, wherein the outboard leg (22) is provided with an elongated aperture (25), whose purpose and function will be described presently.

Turning now to FIGS. 1, 2 and 3, it can be seen that the head rest unit (13) comprises in general a padded head rest member (30) having a mounting post (31) projecting outwardly from the rear face (32) of the head rest member (30); wherein the mounting post (31) is provided with a threaded aperture (not shown) dimensioned to receive a conventional fastener (33) which extends through the elongated aperture (25) in the spring member (20) for operatively engaging the head rest member (30) at a selected height relative to the outboard leg (22) of the spring member (20).

At this juncture it should be appreciated that when the support unit (11) is suspended from the door (100) the resistance unit (12) may be selectively positioned relative to the support unit (11); and, the head rest unit

(13) may be selectively positioned relative to the resistance unit (12).

In this manner, the user may choose the degree of resistance offered by the resistance unit (12) relative to the head rest unit (13); wherein, the lower the position of the head rest member (30) relative the outboard leg (22) of the spring member (20) the less the resistance provided by the spring member (20) and vice versa.

Furthermore once the resistance level has been chosen, the user would then move the resistance unit (12) relative to the support unit (11) to position the head rest member (30) at the desired vertical height.

In addition due to the elongated nature of the support member (14) there will be at least some inherent flexing of the lower end (14") of the support member (14) relative to the door; wherein that degree of flexibility is accommodated by the outward curvature of the lower end (14") of the support member (14) and the padded lateral stability provided by the horizontal brace element (16).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

We claim:

1. A neck exercising apparatus comprising:

a support unit including an elongated support member having an upper end, a lower end, and an intermediate portion wherein the support member is provided with means for operatively connecting the support member to a conventional vertical surface;

a resistance unit operatively connected to, said support member wherein said resistance unit comprises a generally U-shaped leaf spring member having an inboard leg and an outboard leg;

a head rest unit including a head rest member operatively connected to the outboard leg of said leaf spring member;

wherein, the intermediate portion of the support member is provided with an elongated slot; the inboard leg of the spring member is provided with a plurality discrete mounting apertures; and, the fastening elements are provided to operatively secure the spring member at a desired height relative to said support member.

2. The apparatus as in claim 1; wherein, the head rest member is further provided with a rearwardly projecting mounting post; the outboard leg of the spring member is provided with an elongated aperture; and a fastening element is provided to operatively secure the head rest member at a desired height relative to the outboard leg of said spring member.

3. The apparatus as in claim 1; wherein, the lower end of said support member is provided with a horizontal brace element having front and back surfaces.

4. The apparatus as in claim 3; wherein, the back surface of the horizontal brace element is provided with a cushioning member.

5. The apparatus as in claim 4; wherein, the lower end of said support member is curved outwardly relative to said vertical surface.

* * * * *